US006298592B1

(12) United States Patent
Baier

(10) Patent No.: US 6,298,592 B1
(45) Date of Patent: Oct. 9, 2001

(54) DISPLAY DEVICE FORMED FROM TWO TRANSPARENT PANELS

(76) Inventor: Siegfried E Baier, 6550 Canyon Ranch Rd., Salt Lake City, UT (US) 84121

( * ) Notice: Subject to any disclaimer, the term of this patent is extended or adjusted under 35 U.S.C. 154(b) by 0 days.

(21) Appl. No.: 09/189,126

(22) Filed: Nov. 10, 1998

(51) Int. Cl.[7] ..... G09F 7/02

(52) U.S. Cl. ..... 40/611; 40/771; 40/774

(58) Field of Search ..... 40/611, 771, 772, 40/774, 661

(56) References Cited

U.S. PATENT DOCUMENTS 4,388,770 * 6/1983 Manor ..... 40/1.6
5,743,449 * 4/1998 McBride ..... 40/904

FOREIGN PATENT DOCUMENTS

508432 * 6/1939 (GB) ..... 40/FOR 156

* cited by examiner

*Primary Examiner*—Cassandra H. Davis
(74) *Attorney, Agent, or Firm*—Terry M. Crellin

(57) ABSTRACT

A display device for displaying sheet-like materials from opposite sides of the device comprises two planar panels. Each of the panels are made of a transparent material, and the two panels are hinged together along respective, corresponding side edges thereof. The panels can thus be moved from a first position in which the panels lie substantially side-by-side to a second position in which the panels pivot about a hinge axis of the hinged sides of the panels to fan apart in a manner similar to adjacent pages of a book. Strips of hook and pile attachment materials are adhered to facing edges of the panels so that when the panels are in their first position, the strips of hook and pile attachment materials engage each other along the mutually respective side edges of the panels to firmly hold the panels in their side-by-side, overlying position. Sheet-like materials can be inserted between the panels when the panels are in their second position, and the panels can then be closed to their first position so that the sheet materials can be viewed through the panels.

9 Claims, 3 Drawing Sheets

DISPLAY DEVICE FORMED FROM TWO TRANSPARENT PANELS

BACKGROUND OF THE INVENTION

1. Field of the Invention

The present invention relates to display apparatus and in particular to signs for use in advertising, wherein photographs and other sheet-like materials can readily be removed from and replaced within the display device, and further wherein such photographs or other sheet-like materials are sealed within the display apparatus so that moisture cannot infiltrate the photographs or other sheet-like materials.

2. State of the Art

Signs and other display apparatus have been designed to sell many different type commodities. Generally, signs have at least one face upon which wording, pictures, graphics and combinations thereof are displayed. Occasionally signs are used that have two oppositely facing faces, with the material to be displayed being applied to each of the opposite facing faces. Signs have been used in which the material to be displayed is painted on or attached to a planar panel and a transparent panel is positioned over the displayed material on the underlying panel.

It has been found that it is highly desirable, especially when selling real estate, to provide a sign that is capable of displaying photographs of the interior of the home that is being advertised. Prospective purchasers have been found to be inclined to look at the photographs on a sign in front of a home to see what the interior of the home looks like, even when the prospective purchasers were not all that impressed with the exterior of the home. In a large number of instances, the prospective purchaser will see something in the photographs of the interior of a home that is appealing and will then take the time to inspect the property more carefully. A sign that displays photographs of the interior of a home has been found to definitely attract more potential buyers than conventional signs that are placed outside a home, even signs that have a dispenser for providing a fact sheet covering the home. A sign that displays photographs of the interior of the home attracts the interest of potential buyers that would otherwise simply drive by the home. The sign gets people out of their cars and into the home.

An extensive search of prior art represented by U.S. Patents has been made, and there was no art found showing or suggesting signs that have opposite transparent sides, with the ability to quickly and readily place photographs or other sheet-like materials within the sign to show through the opposite transparent sides. There was further no suggestion found in the prior art patents as to such a sign or display apparatus in which the photographs or other sheet-like materials could be rapidly and easily changed and wherein the photographs or other sheet-like materials were protected from infiltration by moisture when they were placed in the sign or display apparatus.

OBJECTIVES AND BRIEF DESCRIPTION OF THE INVENTION

A principal objective of the invention is to provide a novel display apparatus that has two panels made of a transparent material, with means for positioning the panels in substantially planar, side-by-side orientation so that photographs or other sheet-like materials can be placed between the transparent panels and viewed from the opposite, exposed sides of the display apparatus.

A further objective of the present invention is to provide such a display apparatus in which the two panels are hingedly attached to each other along respective, common side edges of the panels so that the panels can pivot about the hinge axis of the hinging means so as to allow the panels to pivot apart from each other in a manner of two adjacent pages of a book.

A still further objective of the present invention is to provide a display apparatus formed by two hinged panels made of a transparent material, with the panels being hinged together along common respective side edges of the panels and with strips of hook and pile attachment members extending along at least the side edges of the panels that are opposite to the hinged side edges, whereby the hook and pile attachment members firmly engage each other when the panels are pivoted together to firmly hold the panels together in side-by-side orientation.

An additional object of the present invention is to provide a display apparatus formed by two hinged panels made of a transparent material, with the panels being hinged together along common respective side edges of the panels and with strips of hook and pile attachment members extending along at least the side edges of the panels that are opposite to the hinged side edges, and further wherein a sheet of resilient material is positioned between the two panels when the panels are pivoted together so that the sheet of resilient material is compressed between the panels such that photographs and other sheet-like materials that are positioned between the sheet of resilient material and an inner face of a respective panel to seal the photographs or other sheet-like materials against infiltration by moisture.

The above objectives are achieved in accordance with the present invention by providing a novel display device that is formed from two planar panels that are made from transparent material such as clear acrylic plastic. The panels are hinged together along mutually respective, corresponding side edges so that the panels can fold together to a position in which the panels are substantially side-by-side so that the first panel overlies the second panel with all side edges of the first panel being positioned closely adjacent to corresponding, respective side edges of the second panel. The panels can also be pivoted about the hinge axis of the hinging mechanism so that the panels fan out from each other to an open position in a manner similar to adjacent pages of a book.

At least the side edges of each of the panels that are opposite to the hinged side edges, and preferably all side edges of both panels other than the side edges that are hinged together are provided with relatively narrow strips of hook and pile materials marketed under the tradename Velcro. The width of the strips need not be more than about one-half inch, and as is well known in the art hook material is applied on edges of one panel that engage pile material that is applied on mutually respective edges of the other panel. The hook and pile material firmly holds the two panels in their side-by-side, overlying position, but allow the panels to be separated so that the panels can be pivoted to their open position.

Sheet-like materials, such as photographs or graphics, can easily and readily be placed between the panels so that the photographs or graphics is visible through the opposite panels. When the panels are closed, the photographs or graphics are retained within the display device and protected from the elements. The photographs or graphics can quickly and easily be changed by opening the panels, removing the old photographs or graphics and replacing the old photographs or graphics with the desired new photographs or graphics. In an especially preferred embodiment of the invention, a sheet of resilient material, preferably resilient foamed polymeric material, lies between the panels when the panels are moved to their closed position. The sheet-like-materials are then inserted between a face of the sheet of resilient material and a face of a corresponding panel. The sheet-like-materials are sealed between the face of the panel and the face of the sheet of resilient material so that moisture can not infiltrate the sheet-like materials.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENTS

Figure 1:
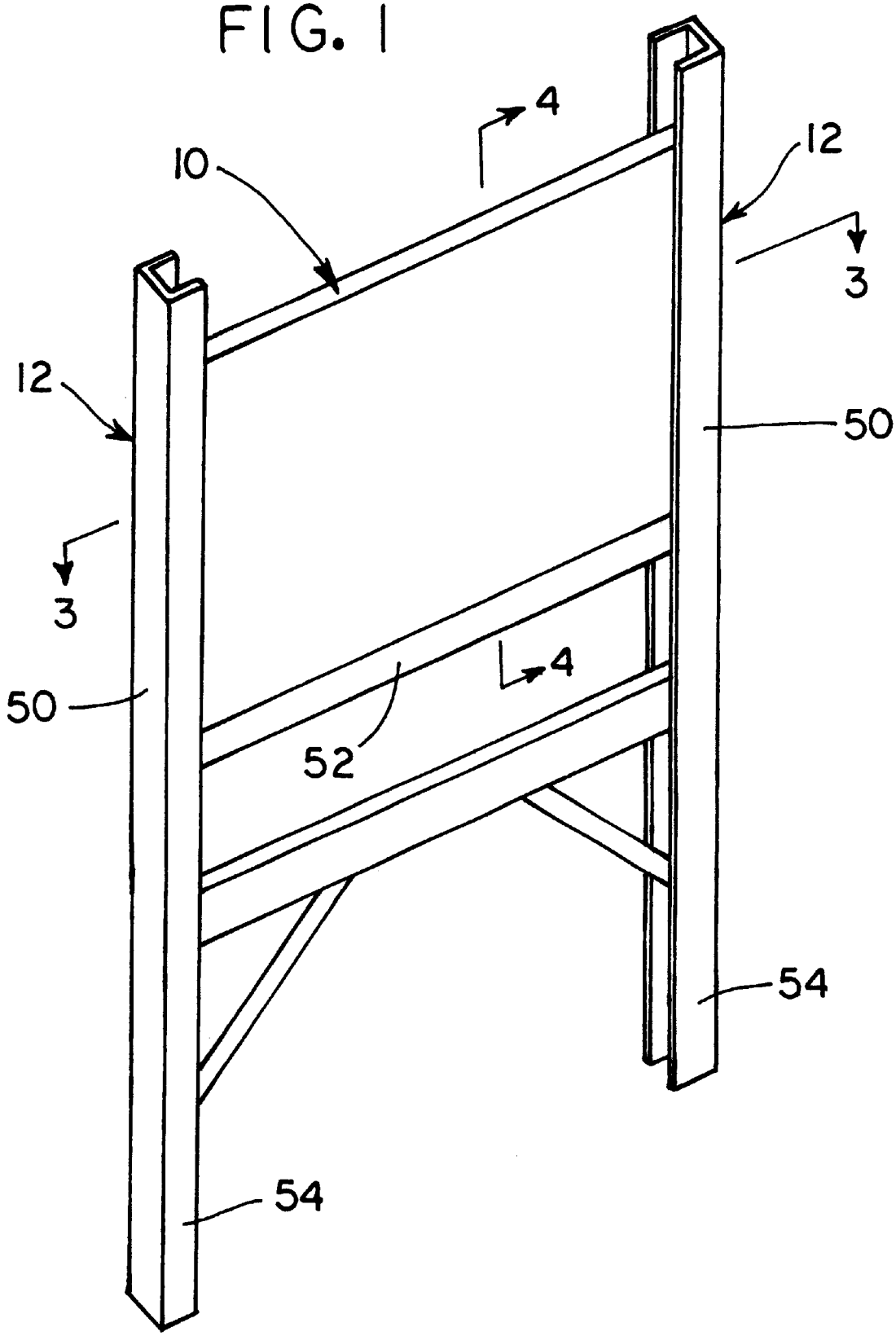
FIG. 1 is a pictorial representation of a display device in accordance with the present invention, with the display device being held in a supplemental frame that takes the form of a real estate sign which is placed in the ground in front of a home.

Referring to the drawings, a particularly preferred embodiment of a display device 10 in accordance with the present invention is illustrated in which the display device 10 is combined with a frame 12 that makes the display device 10 especially useful as a lawn sign to place in front of a home that is for sale. Photographs of interior rooms of the home are visible through the opposite sides of the sign, and as noted previously, it has been found that the sign displaying photographs of the interior rooms of a home results in attracting much more attention from potential buyers than conventional real estate signs that are placed in the front of a home that is for sale.

Figure 2:
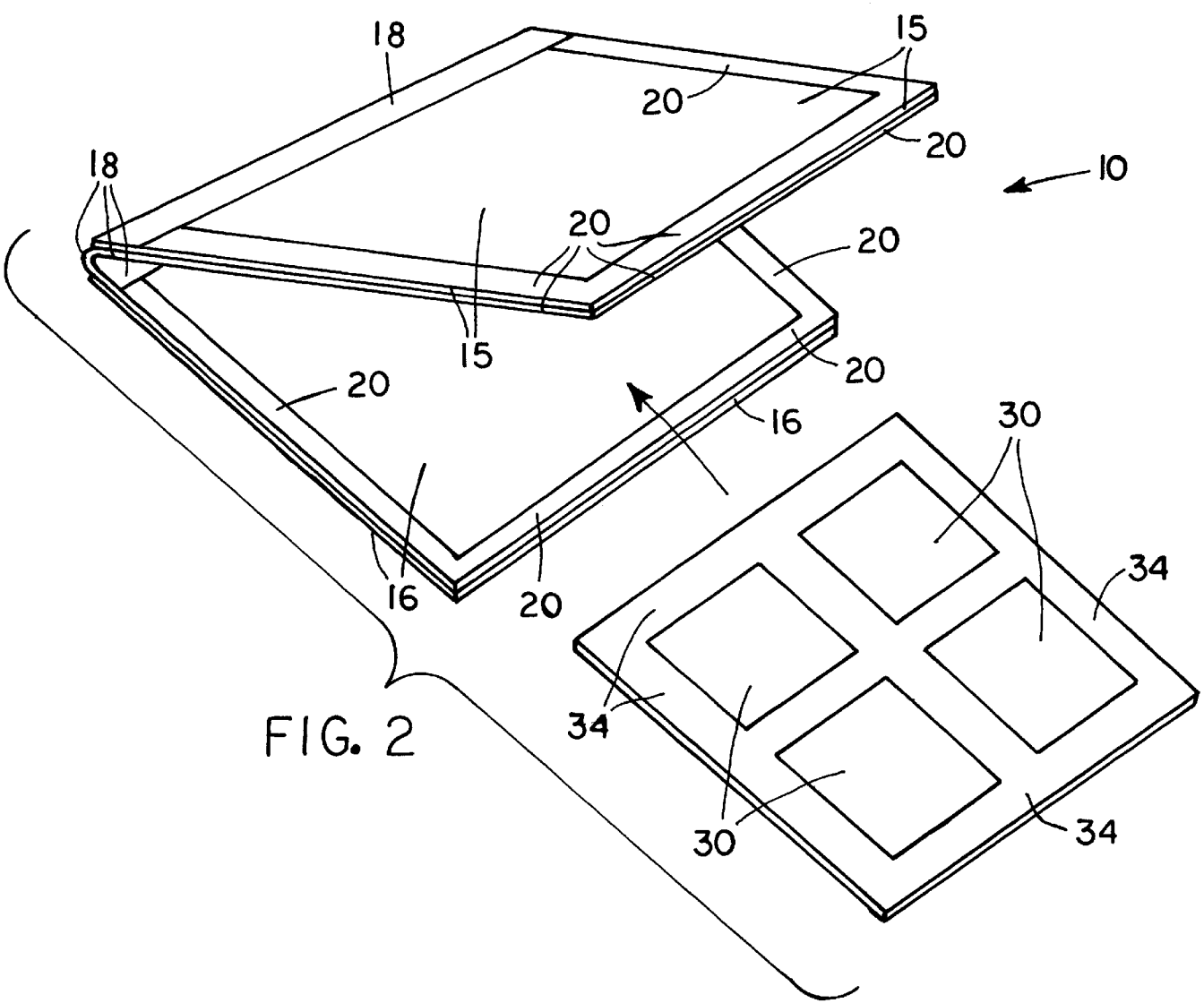
FIG. 2 is a pictorial of the display device removed from the supplemental frame, with the panels of the display device moved to an open position for insertion of sheet-like materials into the device.
Figure 3:
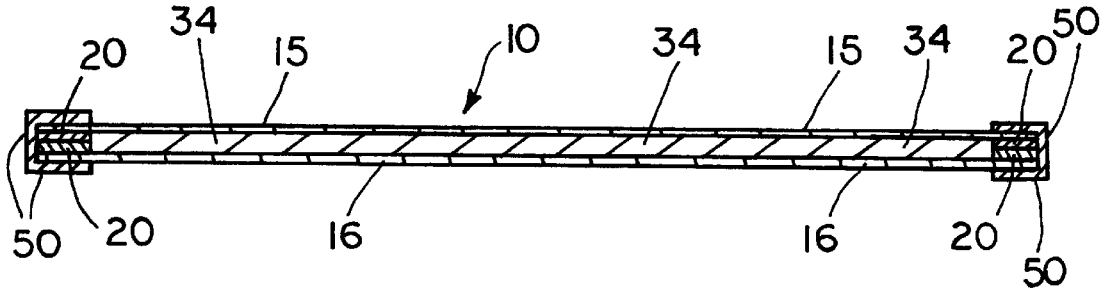
FIG. 3 is a across section taken along line 3—3 of FIG. 1.
Figure 4:
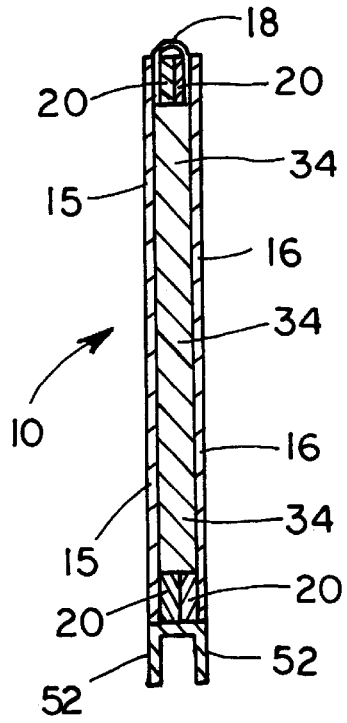
FIG. 4 is a cross section taken along line 4—4 of FIG. 1.

The display device 10 is not limited to displaying photographs or to real estate signs but can be used in various applications to display sheet-like materials from opposite sides of the device 10. Photographs or other sheet-like materials can be readily removed from and replaced within the display device 10. The display device comprises first and second planar panels 15 and 16 (see in particular FIGS. 2–4). Each of the panels 15 and 16 is made of a transparent material such as acrylic polymeric material Means are provided for hinging the planar panels 15 and 16 together along respective, corresponding, first side edges of the panels 15 and 16 so that the panels 15 and 16 can be moved from a closed, first position as shown in FIGS. 1, 3 and 4 to an open, second position as shown in FIG. 2. In the closed, first position, the panels 15 and 16 lie substantially side-by-side so that the first panel 15 overlies the second panel 16 with all side edges of the first panel 15 being positioned closely adjacent to corresponding, respective side edges of the second panel 16. In the open, second position, the panels 15 and 16 pivot about a hinge axis of the means for hinging the planar panels 15 and 16 together in a manner similar to fanning apart adjacent pages of a book. As illustrated, the hinging means comprises a live hinge 18 formed by a strong, fiber reinforced, adhesive tape that is attached to the respective side edges of the panels 15 and 16.

The panels 15 and 16 are held firmly together in their closed, first position by strips of hook and pile attachment materials 20 that are adhered to faces of the panels 15 and 16 that face each other when the panels 15 and 16 are in their closed, first position. The hook and pile attachment materials 20 are positioned adjacent to at least the side edges of the panels 15 and 16 that are opposite to the first side edges of the panels 15 and 16, i.e., to side edges opposite the hinged together side edges of the panels 15 and 16. In the preferred embodiment illustrated in the drawings, hook and pile materials 20 are positioned adjacent to all side edges of the panels 15 and 16 other than the side edges that are hinged together. The hook and pile attachment materials 20 are commonly sold under the tradename Velcro. The strips of the hook and pile attachment materials 20 preferably extend continuously along each of the side edges of the panels 15 and 16 so that when the panels 15 and 16 are in their closed, first position, the strips of hook and pile attachment materials 20 engage each other along the mutually respective side edges of the panels 15 and 16 to firmly hold the panels 15 and 16 in their side-by-side, overlying, closed position.

Photographs or other sheet-like materials 30 can be inserted between the panels 15 and 16 when the panels 15 and 16 are in their open, second position. The panels 15 and 16 can then be closed to their closed, first position with the panels 15 and 16 lying substantially side-by-side so that the sheet materials 30 can be viewed through the panels 15 and 16.

The display device 10 of the present invention further advantageously incorporates a planar sheet of resilient material 34 that lies between the panels 15 and 16 when the panels 15 and 16 are in their closed, first position. The sheet-like materials 30 can be inserted between a face of the sheet of resilient material 34 and a face of a corresponding panel 15 and 16. Preferably, the sheet of resilient material 34 is shaped and has a size such that perimeter edges of the sheet of resilient material 34 lie substantially adjacent to inside perimeter edges of the strips of hook and pile attachment materials 20 and substantially adjacent to all side edges of the panels 15 and 16 that have no strips of hook and pile attachment materials 20 extending therealong. The sheet of resilient material 34 has a thickness sufficient so that the sheet of resilient material 34 is compressed when the panels 15 and 16 are in their closed, first position. The sheet-like materials 30 inserted between a face of the sheet of resilient material 34 and a face of a corresponding panel 15 or 16 are sealed in place between the sheet of resilient material 34 and the corresponding panel 15 or 16 so that moisture cannot infiltrate the sheet-like materials 30.

As mentioned previously, the display device 10 of the present invention can advantageously be combined with a frame 12 to provide a unique lawn sign for selling real estate. The frame 12 comprises two spaced apart, substantially parallel channel members 50. The channel members 50 have open sides facing each other so that opposite side edges of the display device 10 can be received in sliding fashion within the open sides of the channel members 50. A lower support member 52 extends between respective lower ends of the parallel channel members 50 to support a lower side edge of the display device 10 when the display device 10 is received within the channel members 50. At least two legs 54 extend downwardly beneath the lower support member 52 to hold the channel members 50 in an upright orientation so that the panels 15 and 16 of the display device 10 are maintained in a substantially vertical orientation.

In the preferred embodiment of the display device 10 as illustrated in the drawings, each of the panels 15 and 16 are substantially rectangular in shape with top and bottom edges that are substantially parallel with each other and first and second side edges that are substantially parallel with each other. The planar panels 15 and 16 are hinged together along respective, corresponding, top edges of the panels 15 and 16 by the live hinge 18 to move from a closed, first position in which the panels 15 and 16 lie substantially side-by-side so that the first panel 15 overlies the second panel 16 with all edges of the first panel 15 being positioned closely adjacent to corresponding, respective edges of the second panel 16 to a second position in which the panels 15 and 16 fan apart in a manner similar to adjacent pages of a book by pivoting about a hinge axis of the live hinge 18.

Strips of hook and pile attachment materials 20 are adhered to faces of the panels 15 and 16, with the attachment materials 20 being positioned adjacent to the bottom edges and the first and second side edges of each of the panels 15 and 16. The strips of hook and pile attachment materials 20 extend continuously along each of the bottom edges and the first and second side edges of the panels 15 and 16.

Although preferred embodiments of the display device of the present invention have been illustrated and described, it is to be understood that the present disclosure is made by way of example and that various other embodiments are possible without departing from the subject matter coming within the scope of the following claims, which subject matter is regarded as the invention.

What is claimed is:

1. A display device that is capable of displaying sheet material from opposite sides of the device, wherein said sheet material can be readily removed from and replaced within said display device, said display device comprising first and second planar panels, each of said panels being made of a transparent material;

means for hinging said planar panels together along respective, corresponding, first side edges of said panels so that said panels can be moved from a first position in which said panels lie substantially side-by-side so that said first panel overlies said second panel with all side edges of said first panel being positioned closely adjacent to corresponding, respective side edges of said second panel to a second position in which said panels pivot about a hinge axis of said means for hinging said planar panels together in a manner similar to adjacent pages of a book;

a planar sheet of resilient material that lies between said panels when said panels are in their first position;

strips of hook and pile attachment materials adhered to faces of said panels that face each other when said panels are in their first position, with said attachment materials being positioned adjacent to at least side edges of said panels that are opposite to said first side edges of said panels, said strips of hook and pile attachment materials extending continuously along each of said side edges of said panels, so that when said panels are in their first position, said strips of hook and pile attachment materials engage each other along the mutually respective side edges of said panels to firmly hold said panels in their side-by-side, overlying position, whereby sheet material can be inserted between a face of said sheet or resilient material and a face of a corresponding panel when said panels are in their second position, and said panels can then be closed to their first position with said panels lying substantially side-by-side so that said sheet materials can be viewed through said panels.

2. The display device in accordance with claim 1 wherein said strips of hook and pile attachment means extend continuously along all side edges of said panels other than said first side edges of said panels.

3. The display device in accordance with claim 2 wherein said sheet of resilient material is shaped and has a size such that perimeter edges of said sheet of resilient material lie substantially adjacent to inside perimeter edges of said strips of hook and pile attachment materials and substantially adjacent to all side edges of said panels that have no strips of hook and pile attachment materials extending therealong.

4. The display device in accordance with claim 3 wherein said sheet of resilient material has a thickness sufficient so that said sheet of resilient material is compressed when said panels are in their first position, whereby said sheet material that is inserted between a face of said sheet of resilient material and a face of a corresponding panel is sealed in place between said sheet of resilient material and said corresponding panel so that moisture cannot infiltrate said sheet material.

5. The display device in accordance with claim 1 further in combination with a frame, said frame comprising two spaced apart, substantially parallel channel members, said channel members having open sides facing each other so that opposite side edges of said display device can be received in sliding fashion within said open sides of said channel members;

a lower support member extending between respective lower ends of said parallel channel members to support a lower side edge of said display device when said display device is received within said channel members; and at least two legs that extend downwardly beneath said lower support member to hold said channel members in an upright orientation so that said panels of said display device are maintained in a substantially vertical orientation.

6. A display device that is capable of displaying sheet materials from opposite sides of the device while sealing the sheet materials from moisture, and further wherein said sheet materials can be readily removed from and replaced within said display device, said display device comprising first and second planar panels, each of said panels being made of a transparent material and each of said panels being substantially rectangular in shape with top and bottom edges that are substantially parallel with each other and first and second side edges that are substantially parallel with each other;

means for hinging said planar panels together along respective, corresponding, top edges of said panels so that said panels can be moved from a first position in which said panels lie substantially side-by-side so that said first panel overlies said second panel with all edges of said first panel being positioned closely adjacent to corresponding, respective edges of said second panel to a second position in which said panels fan apart in a manner similar to adjacent pages of a book by pivoting about a hinge axis of said means for hinging said planar panels together;

a planar sheet of resilient material that lies between said panels when said panels are in their first position;

strips of hook and pile attachment materials adhered to faces of said panels that face each other when said panels are in their first position, with said attachment materials being positioned adjacent to at least the bottom edges and the first and second side edges of each of said panels, said strips of hook and pile attachment materials extending continuously along each of said bottom edges and said first and second side edges of said panels, so that when said panels are in their closed position, said strips of hook and pile attachment materials engage each other along the mutually respective edges of said panels to firmly hold said panels in their closed position, whereby sheet materials can be inserted between a face of said sheet of resilient material and a face of a corresponding panel when said panels are in their second position, and said panels can then be closed to their first position with said panels lying substantially side-by-side so that said sheet materials can be viewed through said panels.

7. The display device in accordance with claim 6 wherein said sheet of resilient material is shaped and has a size such that perimeter edges of said sheet of resilient material lie substantially adjacent to inside perimeter edges of said strips of hook and pile attachment materials and substantially adjacent to all side edges of said panels that have no strips of hook and pile attachment materials extending therealong.

8. The display device in accordance with claim 7 wherein said sheet of resilient material has a thickness sufficient so that said sheet of resilient material is compressed when said panels are in their first position, whereby said sheet material that is inserted between a face of said sheet of resilient material and a face of a corresponding panel is sealed in place between said sheet of resilient material and said corresponding panel so that moisture cannot infiltrate said sheet material.

9. The display device in accordance with claim 6 further in combination with a frame, said frame comprising two spaced apart, substantially parallel channel members, said channel members having open sides facing each other so that respective first and second side edges of said display device can be received in sliding fashion within said channel members;

a lower support member extending between respective lower ends of said parallel channel members to support a bottom edge of said display device when said display device is received within said channel members; and at least two legs that extend downwardly beneath said lower support member to hold said channel members in an upright orientation so that said panels of said device are maintained in a substantially vertical orientation.

* * * * *